US006246059B1

(12) United States Patent
Maishev et al.

(10) Patent No.: US 6,246,059 B1
(45) Date of Patent: Jun. 12, 2001

(54) ION-BEAM SOURCE WITH VIRTUAL ANODE

(75) Inventors: Yuri Maishev, Moscow (RU); James Ritter, Fremont, CA (US); Leonid Velikov; Alexander Shkolnik, both of San Carlos, CA (US)

(73) Assignee: Advanced Ion Technology, Inc.

( * ) Notice: Subject to any disclaimer, the term of this patent is extended or adjusted under 35 U.S.C. 154(b) by 0 days.

(21) Appl. No.: 09/263,058

(22) Filed: Mar. 6, 1999

(51) Int. Cl.[7] ..... H01J 27/02

(52) U.S. Cl. ..... 250/426; 250/423 R; 315/111.81; 315/111.91

(58) Field of Search ..... 250/426, 423 R; 315/111.81, 111.91

(56) References Cited

U.S. PATENT DOCUMENTS 4,126,806 * 11/1978 Kapetanakos et al. ..... 250/423 R
4,710,283 12/1987 Singh et al. .
6,002,208 * 12/1999 Maishev et al. ..... 250/423 R

FOREIGN PATENT DOCUMENTS 2030807 3/1995 (RU) .

OTHER PUBLICATIONS

Smith, *Thin Film Deposition*, 1995, pp. 382–387.

* cited by examiner

*Primary Examiner*—Jack Berman

(57) ABSTRACT

A cold-cathode type ion-beam source with a closed-loop ion-emitting slit and electrons drifting in crosses electric and magnetic fields is characterized by the absence of a metal anode which is replaced by a pair of positively charged bodies, such as concentric rings of a conductive material which are located inside a hollow housing of the ion source and are connected to a source of a positive potential. The ion-emitting slit is located between these rings in an upstream position in the direction of propagation of the ion beam. Replacement of a metallic anode with an anodic plasma, i.e., with a "virtual anode", which is formed by a Penning-type discharge, descreases contamination of the ion beam by products of erosion of a metallic anode and increases the ion beam current, which results in more effective ionization of the workout gas.

18 Claims, 8 Drawing Sheets

ION-BEAM SOURCE WITH VIRTUAL ANODE

FIELD OF THE INVENTION

The present invention relates to the field of ion-emission technique, particularly to cold-cathode type ion-beam sources having closed-loop ion-emitting slits with electrons drifting in crossed electric and magnetic fields.

BACKGROUND OF THE INVENTION AND DESCRIPTION OF THE PRIOR ART

An ion source is a device that ionizes gas molecules and then focuses, accelerates, and emits them as a narrow beam. This beam is then used for various technical and technological purposes such as cleaning, activation, polishing, thin-film coating, or etching.

For better understanding the principle of the present invention, it would be expedient to describe in detail a known ion-beam source of the type to which the invention pertains. Such an ion source is described, e.g., in Russian Patent No. 2,030,807 issued in 1995 to M. Parfenyonok, et al. The patent describes an ion source that comprises a magnetoconductive housing used as a cathode having an ion-emitting slit, an anode arranged in the housing symmetrically with respect to the emitting slit, a magnetomotance source, a working gas supply system, and a source of electric power supply.

FIGS. 1 and 2 schematically illustrate the aforementioned known ion source with a circular ion-beam emitting slit. More specifically, FIG. 1 is a sectional side view of an ion-beam source with a circular ion-beam emitting slit, and FIG. 2 is a sectional plan view along line II—II of FIG. 1.

The ion source of FIGS. 1 and 2 has a hollow cylindrical housing 40 made of a magnetoconductive material such as Armco steel (a type of a mild steel), which is used as a cathode. Cathode 40 has a cylindrical side wall 42, a closed flat bottom 44 and a flat top side 46 with a circular ion emitting slit 52. A working gas supply hole 53 is formed in flat bottom 44. Flat top side 46 functions as an ion-accelerating electrode. Placed inside the interior of hollow cylindrical housing 40 between bottom 44 and top side 46 is a magnetic system in the form of a cylindrical permanent magnet 66 with poles N and S of opposite polarity. An N-pole faces flat top side 46 and S-pole faces bottom side 44 of the ion source. The purpose of a magnetic system 66 with a closed magnetic circuit formed by parts 66, 46, 42, and 44 is to induce a magnetic field in ion emitting slit 52. It is understood that this magnetic system is shown only as an example and that it can be formed in a manner described, e.g., in U.S. Pat. No. 4,710,283 issued to Singh, et al. in 1987. A circular annular-shaped anode 54 which is connected to a positive pole 56*a* of an electric power source 56 is arranged in the interior of housing 40 around magnet 66 and concentric thereto. Anode 54 is fixed inside housing 40 by means of a ring 48 made of a non-magnetic dielectric material such as ceramic. Anode 54 has a central opening 55 in which aforementioned permanent magnet 66 is installed with a gap between the outer surface of the magnet and the inner wall of opening 55. A negative pole 56*b* of electric power source is connected to housing 40 which is grounded at GR.

Located above housing 40 of the ion source of FIGS. 1 and 2 is a sealed vacuum chamber 57 which has an evacuation port 59 connected to a source of vacuum (not shown). An object OB to be treated is supported within chamber 57 above ion emitting slit 52 by an insulator block 61 rigidly attached to the housing of vacuum chamber 57 by a bolt 63 but so that object OB remains electrically isolated from the housing of vacuum chamber 57. However, object OB is electrically connected via a line 56*c* to negative pole 56*b* of power source 56. Since the interior of housing 40 communicates with the interior of vacuum chamber 57, all lines that electrically connect power source 56 with anode 54 and object OB should pass into the interior of housing 40 and vacuum chamber 57 via conventional commercially-produced electrical feedthrough devices which allow electrical connections with parts and mechanisms of sealed chambers without violation of their sealing conditions. In FIG. 1, these feedthrough devices are shown schematically and designated by reference numerals 40*a* and 57*a*. Reference numeral 57*b* designates a seal for sealing connection of vacuum chamber 57 to housing 40.

The known ion source of the type shown in FIGS. 1 and 2 is intended for the formation of a unilaterally directed tubular ion beam. The source of FIGS. 1 and 2 forms a tubular ion beam IB emitted in the direction of arrow A and operates as follows.

Vacuum chamber 57 is evacuated, and a working gas is fed into the interior of housing 40 of the ion source. A magnetic field is generated by magnet 66 in the accelerating gap between anode 54 and cathode 40, whereby electrons begin to drift in a closed path within the crossed electrical and magnetic fields. A plasma 58 is formed between anode 54 and top cathode plate 46. When the working gas is passed through an ion-acceleration and ionization gap 52*a* (hereinafter referred to as "ionization gap"), tubular ion beam IB, which is propagated in the axial direction of the ion source shown by an arrow A, is formed in the area of an ion-emitting slit 52 and in ionization gap 52*a* between anode 54 and top cathode plate 46.

The above description of the operation of the ion source is simplified to ease understanding of the principle of the invention. In reality, the phenomenon of generation of ions in the ion source with a closed-loop drift of electrons in crossed electric and magnetic fields is of a more complicated nature and consists in the following.

When, at starting the ion source, a voltage between anode 54 and cathode 40 reaches a predetermined level, a gas discharge occurs in gap 52*a*. As a result, the electrons, which have been generated as a result of ionization, begin to migrate towards anode 54 under the effect of the electric field, colliding with the molecules of working gas and moving along specific trajectories described below. The space in which the electrons drift is confined between an inner part 46*a* and an outer part 46*b* of top cathode plate 46, which form ion-emitting slit 52, and the surface of anode 54 facing top cathode plate 46.

The principle of operation of the ion-beam source to which the present invention pertains can be better understood after consideration of a direct current vacuum magnetron a part of which is shown schematically on FIG. 1A. If one assume that in ion source of FIG. 1 ion-emitting slit 52 is absent and that the magnetic field B between cathode 46' and anode 54' passes parallel to the planes of the anode and cathode (i.e., perpendicular to the plane of the drawing), then such a system can be considered as the aforementioned direct current vacuum magnetron (hereinafter referred to as "DC magnetron").

In a DC magnetron, the electrons, which are emitted from cathode 46', move toward anode 54'. However, their trajectory is curved under the effect of magnetic field B. When the strength of magnetic field B exceeds a predetermined critical value $B_{cr}$, the electrons do not reach the surface of anode 54' and return back to cathode 46'. More specifically, the electrons begin to move along cycloidal trajectories shown in FIG. 1A. As a result, the electrons are accumulated in the space between cathode 46' and anode 54', and their concentration can reach a significant value. It is known that height H of such a cycloid is equal to so-called doubled Larmor radius $R_L$ which is represented by the following formula:

$$R_L = m_e V / |e| B,$$

where $m_e$ is a mass of the electron, B is the strength of the magnetic field inside the slit, V is a velocity of the electrons in the direction perpendicular to the direction of the magnetic field, and $|e|$ is the charge of the electron (see D. L. Smith. "Thin-Film Deposition". Principles and Practice. McGraw-Hill Inc., New York, p. 384, 1995).

Based on the principle described above, in the construction of ion-beam source shown in FIG. 1, the distance between anode 54 and cathode 46 should be equal to or greater than two Lamnor radii of electrons in the magnetic field.

In contrast to D.C. magnetron shown in FIG. 1A, real ion-beam source of FIG. 1 has a closed-loop ion emitting slit 52 required for forming, extracting, and emitting an ion beam IB toward an object OB. The presence of ion-emitting slit 52 leads to non-uniformities in electric and magnetic fields in the area above anode 54, i.e., in gap 52*a* and in ion-emitting slit 52. This makes the electron drift pattern more complicated than shown in FIG. 1A. The electrons begin to drift not only in gap 52*a*, but also in ion-emitting slit 52. These drifting electrons are responsible for the following two processes: 1) they collide with molecules of the working gas, ionizes them, and thus form positive ions; 2) they compensate for the positive spatial charge of the ion beam.

It should be noted that strictly speaking electrons do not drift in a plane in the ion-emitting slit. However, for the convenience of the description, here and hereinafter such as expressions as "plane of drift of electrons", "drift in the direction of propagation of the ion beam", etc., will be used.

In ion source of FIG. 1, the magnetic field is localized essentially between top parts 46*a* and 46*b* of top cathode plate 46, i.e., in ion-emitting slit 52 and near this slit. This magnetic field practically does not influence on the trajectories of the ions. This is because the Larmor radius of the ion is $(m_i/m_e)^{1/2}$ times the Larmor radius of the electron, where $m_I$ is mass of ion and $m_e$ is mass of electron. For example, for an ion of argon having $m_i$=40 atomic units, the Larmor radius of the ion is 270 times the Larmor radius of the electron.

When a working medium, such as argon which has neutral molecules, is injected into the ionization space inside housing 40, the molecules are ionized by the electrons present in this space and are accelerated by the electric field. As a result, ions are formed and emitted from the slit towards the object.

In the space above anode 56 and in ion-emitting slit 52, the electrons are maintained in high concentration under the effect of crossed electric and magnetic fields. This high concentration ensures effective ionization of the working gas and compensates for the abovementioned positive spatial charge. Thus, it becomes possible to form high-intensity ion beams from various gaseous substances.

The diameter of the tubular ion beam formed by means of such an ion source may reach 500 mm and more.

The ion source of the type shown in FIG. 1 is not limited to a cylindrical configuration and may have an elliptical or an oval-shaped cross section as shown in FIG. 3. FIG. 3 is a cross-sectional view of the ion-beam source having an oval cross section. In FIG. 3 the parts of the ion beam source that correspond to similar parts of the previous embodiment are designated by the same reference numerals with an addition of subscript OV. Structurally, this ion source is the same as the one shown in FIG. 1 with the exception that a cathode $\mathbf{40}_{ov}$, anode $\mathbf{54}_{ov}$, a magnet $\mathbf{66}_{ov}$, and hence an emitting slit (not shown in FIG. 3), have an oval-shaped configuration. As a result, a belt-like ion beam having a width of up to 1400 mm and more can be formed. Such an ion beam source is suitable for treating large-surface objects when these objects are passed over ion beam IB emitted through emitting slit 52.

With 1 to 3 kV voltage on the anode and various working gases, this source makes it possible to obtain ion beams with currents of 0.5 to 1 A. In this case, an average ion energy is within 400 to 1500 eV, and nonuniformity of treatment over the entire width of a 1400 mm-wide object does not exceed ±5%.

However, in the ion sources of the type shown in FIGS. 1 through 3, the volume of the space where electrons drift is limited by metallic anode 54, which should be located close to ion-emitting slit 52. This decreases the residence time of the electrons in a free state and thus decreases efficiency of ionization of the working gas. When the working medium comprises a polyatomic gas, such as $SF_6$, negatively charged ions or high-velocity neutral particles may appear in the near-anode area. These ions and particles may lead to erosion of the anode, and thus to contaminate the ion beam of the source with the material of the anode.

OBJECTS OF THE INVENTION

It is an object of the present invention to provide an ion-beam source with a virtual anode which is characterized by high ion beam current, high efficiency of ionization, reduced degree of contamination of the ion beam with erosion particles due to the absence of a metallic anode, and by possibility of operation of the source in a wider range of pressure.

SUMMARY OF THE INVENTION

A cold-cathode type ion-beam source with a closed-loop ion-emitting slit and electrons drifting in crossed electric and magnetic fields is characterized by the absence of a metal anode which is replaced by a virtual anode in the form of a plasma charged positively with respect to the cathode. During operation of the ion-beam source, this plasma is generated by means of one or two or more concentric rings of a conductive material which are located inside a hollow housing of the ion source and are connected to sources of a positive potential. An electric discharge is generated in the vicinity of the aforementioned rings, where a scattered magnetic field is present. Electrons, generated in the electric discharge, move along helical trajectories (along lines of forces of the magnetic field which pass near the positively charged rings) and oscillate between opposite parts of the cathode-housing of the ion source. This increases free life of the electrons in the discharge, thus improving efficiency of ionization of the working gas fed into the source. The discharge that occurs as a result of the phenomenon described above is close to so-called "Penning discharge" and can exist under pressures much lower than those at which a conventional glow discharge may exist. Plasma which is formed in the aforementioned discharge has an electric potential close to that of the aforementioned rings and functions as a virtual anode of the ion source. On the other hand, the main ionization process occurs between an anode and cathode, as well as in an ion-emitting slit, due to collisional ionization of molecules of the working medium by electrons held and drifting in the crossed electric and magnetic fields. Replacement of a metallic anode with an anodic plasma, i.e., with a "virtual anode", decreases contamination of the ion beam by products of erosion of a metallic anode, and increases the ion beam current, which results in more effective ionization of the working gas.

DETAILED DESCRIPTION OF THE INVENTION

The invention will be described in detail in the form of several embodiments with reference to the accompanying drawings.

Figure 4:
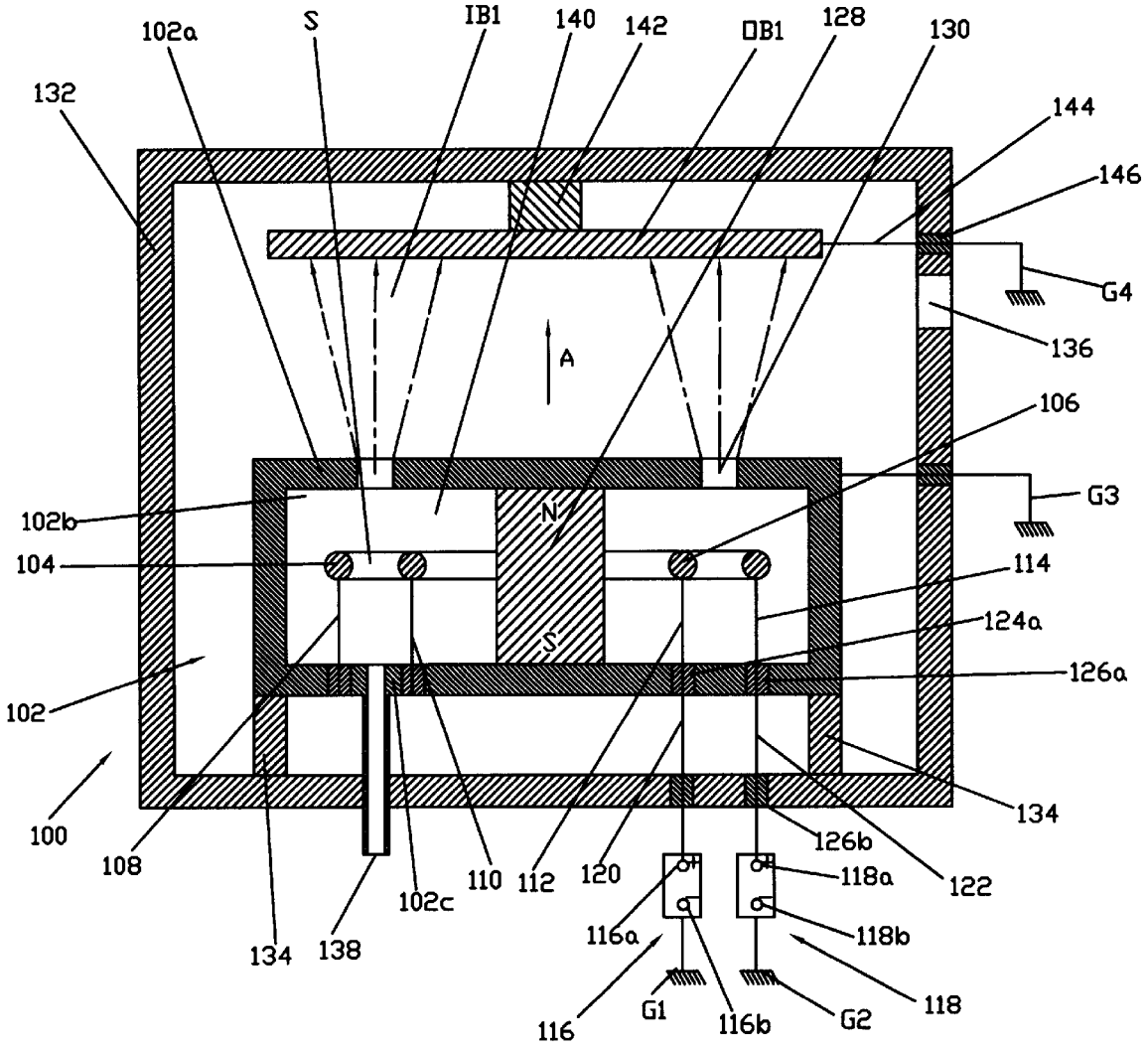
FIG. 4 is a side sectional view of an ion source of the invention with two concentric positively charged rings located inside a hollow housing, the direction of the ion beam propagation being perpendicular to the plane of drift of the electrons.

An embodiment of FIG. 4 illustrates an ion source 100 with two concentric positively charged rings located inside a hollow housing. More specifically, ion source 100 is a source of the type where direction of propagation of the ion beam is perpendicular to the plane of drift of the electrons and is intended for treating flat surfaces. Ion source 100 consists of a hollow box-line housing or cathode 102 and a pair of positively charged concentric bodies, e.g., in the form of rings 104 and 106 made of wires of a heat-resistance metal such as tungsten, molybdenum, etc. The wires may have a cross-sectional diameter within the range from fractions of a millimeter to several millimeters. Housing 102 is made of a magnetoconductive material such as Armco steel and is grounded at G3. Positively-charged bodies or rings 104 and 106 are space from each other and are supported inside hollow housing 102, e.g., by a plurality of conductors 108, 110, 112, 114 (only four of which are shown). Rings 104 and 106 are connected, e.g., via conductors 112, 114, and their continuations 120 and 122, which pass through respective feedthrough devices 124*a*, 124*b* and 126*a*, 126*b*, to positive terminals 1 16*a* and 11 8*a* of direct current sources 116 and 118, respectively. Negative terminals 116*b* and 11 8*b* of these current sources are grounded at G1 and G2. A permanent magnet 128 is placed inside housing 102 in the center of inner ring 106.

Direct current sources 116 and 118 may apply to rings 104 and 106 different potentials for controlling distribution of plasma density in the area of the virtual anode and, hence, to control parameters and the shape of the ion beam.

A top cathode plate 102*a* of housing or cathode 102 has a closed-loop ion-emitting slit 130 which is concentric to rings 104 and 106 and located above them approximately in the middle of a space S between them. An ion-accelerating gap 140 is formed between rings 104, 106 and an upper plate 102*a* of cathode 102.

Housing 102 is installed inside a sealed vacuum chamber 132 and is supported in chamber 132 by an insulating block 134. Vacuum chamber has an evacuation port 136 which is connected to a vacuum pump (not shown). A working gas supply tube 138 which passes through the bottom of chamber 132 is connected to housing 102 for the supply of a working medium into housing 102.

An object OB1 to be treated is supported by an insulating block 142 inside vacuum chamber 132 opposite ion-emitting slit 130. Object OB1 is grounded at G4 by a conductor 144 that passes via a feedthrough device 146 to the outside of chamber 132.

Figure 1:
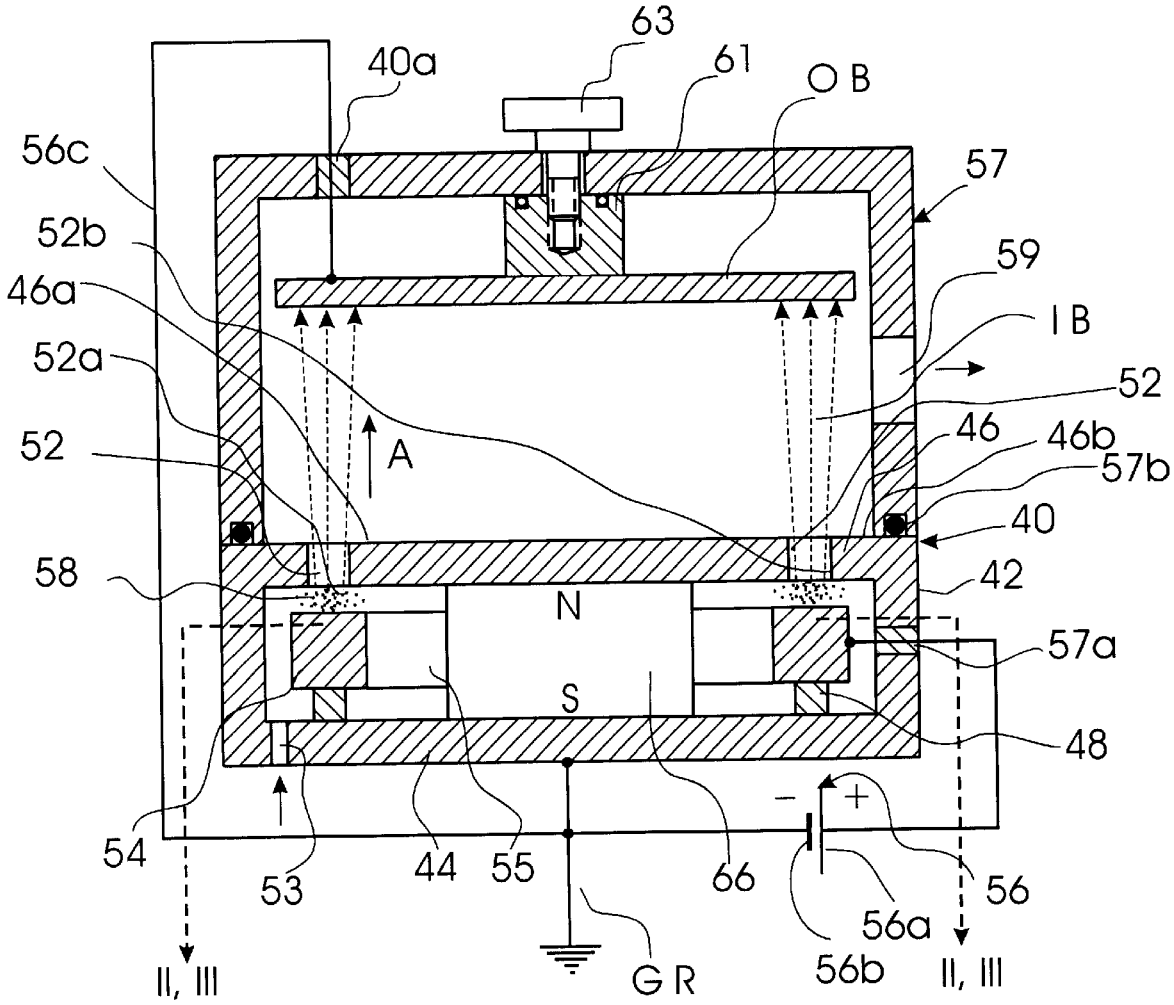
Fig.1 PRIOR ART
FIG. 1 is a sectional side view of a known ion-beam source with a circular ion-beam emitting slit.
Figure 1A:
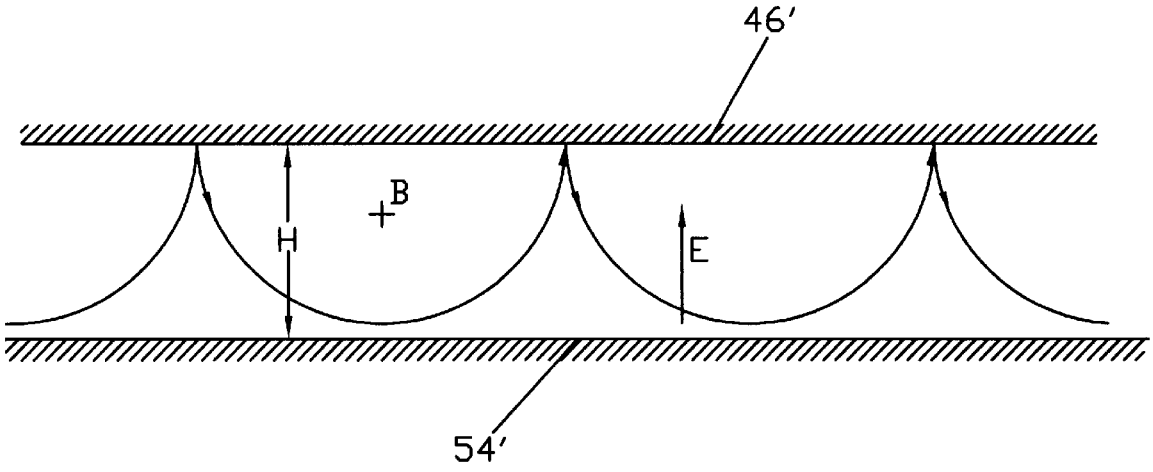
FIG. 1A is a schematic sectional view of DC magnetron.
Figure 2:
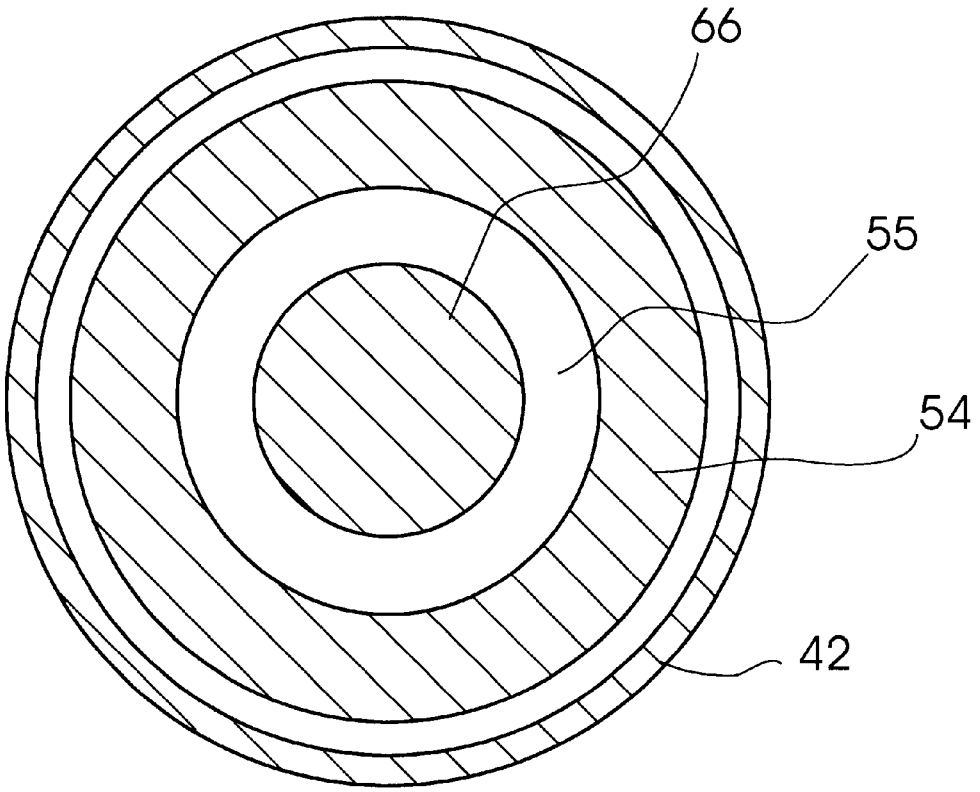
Fig.2 PRIOR ART
FIG. 2 is a sectional plan view along line II—II of FIG. 1 illustrating an ion-beam source of a circular cross section.
Figure 3:
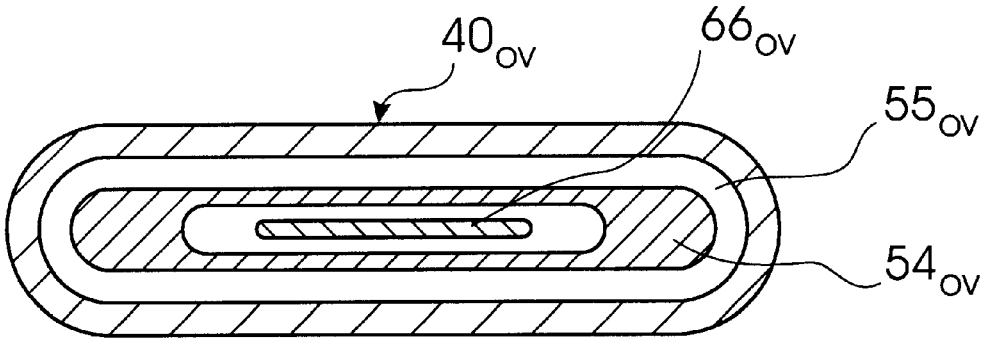
Fig.3 PRIOR ART
FIG. 3 is a cross-sectional view similar to the one of FIG. 2, illustrating an ion-beam source of an oval cross section.

Similar to the conventional ion source of the type shown in FIGS. 1–3, ion-beam source 100 is not limited to a circular configuration and may have an oval or an elliptical form in a plan view of the source.

Figure 5:
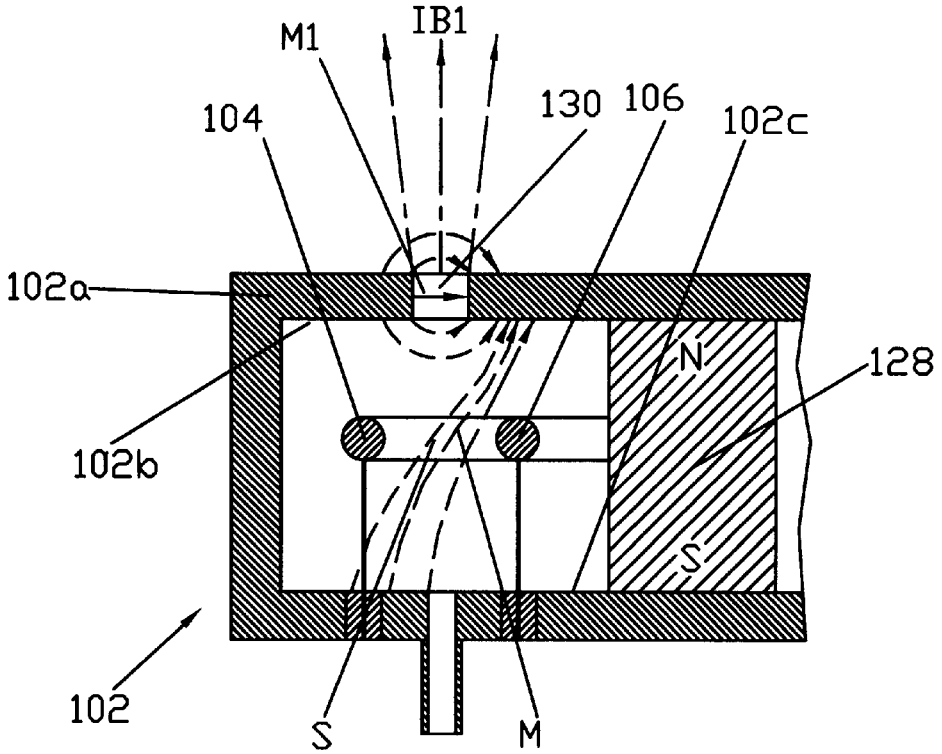
FIG. 5 is a fragmental view of an ion source of FIG. 4 shown on a larger scale.
Figure 5A:
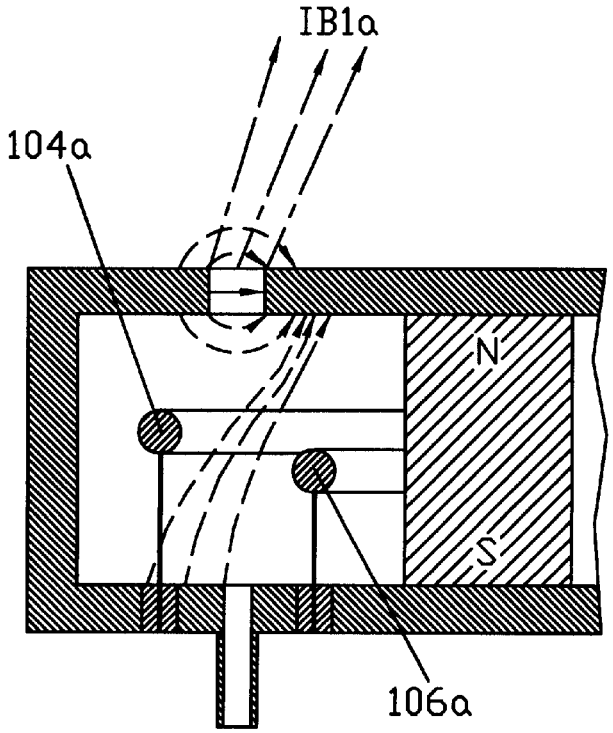
FIG. 5A is a sectional view similar to FIG. 5 illustrating an ion source of the invention with positively-charged rings in different planes.

Ion source 100 operates as follows:

Vacuum chamber 132 is evacuated, and a working gas is fed into the interior of housing 102 of the ion source. A magnetic field shown in FIG. 5 by broken lines M is generated by magnet 128 in space S between positively-charged bodies or rings 104 and 106. FIG. 5 is a fragmental view of ion source 100 shown on a larger scale. Since in ion source 100 of the embodiment of FIG. 4 conventional metal anode 54 of the type shown in FIG. 1 is replaced by a pair of positively-charged bodies or rings 104 and 106, a discharge close to so-called Penning discharge (hereafter referred to as a Penning discharge) is generated between these rings. For the aforementioned magnetic field, rings 104 and 106 function as anodes, and inner surfaces 102*b* and 102*c* function as cathodes. A magnetic field required for maintaining the Penning discharge is a scattered magnetic field generated inside housing 102 in space S between rings 104 and 106. In the embodiment of FIGS. 4 and 5, the Penning discharge magnetic field has orientation essentially perpendicular to the plane passing through both rings 104 and 106. Although in the embodiment of FIG. 4 both rings are in the same plane, one ring may be arranged lower or higher with respect to another ring. This is shown in FIG. 5A, which is a similar to FIG. 5, but illustrates a ring 104*a* raised above concentric ring 106*a*. In this case, the Penning magnetic field will be oriented perpendicular to the plane passing through both rings 106*a* and 104*a*, so that the ion beam IB1*a* will be a converging beam.

In an axial magnetic field, the Penning discharge creates a dense plasma at pressures lower than those at which a conventional glow discharge may exist, i.e., at pressures of $10^{-3}$ to $10^{-6}$ Torr. An ion-beam source of the invention operates at pressures that fall into an intermediate portion of the aforementioned pressure range. In such a Penning discharge, the electrons move along an extended helical path around lines of force of the axial magnetic field. This increases probability of ionization of the molecules of the working gas and creates conditions for discharge under low pressures in the aforementioned pressure range. Due to oscillation of the electrons between the opposite cathode plates, the free-path time of the electrons is also increased in the Penning discharge. The plasma, which is formed as a result of the gas discharge, has a potential close to that of the anode and therefore functions as a virtual anode. This plasma can be used 1) as an effective source of ions for the formation of an ion beam, and 2) as an effective source of electrons, supplied to the area of the crossed electric and magnetic fields, thus increasing efficiency for ionization of the working gas supplied to the source.

Thus, when the working gas passes through the ion-accelerating space 140 and ion-emitting slit 130, tubular ion beam IB1 (FIG. 4), which is propagated in the axial direction of the ion source shown by an arrow A, is formed in the area of an ion-emitting slit 130 and in an accelerating gap 140 between anode rings 104, 106 and an upper plate 102*a* of cathode 102.

Thus, in ion-beam source 100 of the invention, which is based on the use of the Penning discharge, the magnetic field extends in the direction from space S between positively-charged bodies 104, 106 toward ion-emitting slit 130, i.e., in the direction of propagation of ion beam IB1. Another magnetic field, which is shown in FIG. 5 by broken lines M1, is generated across ion-emitting slit 130. As in a conventional ion-beam source of this type, magnetic field M1 is perpendicular to an electric field (not shown) that passes through ion-emitting slit 130 in accordance with the principles described earlier in connection with the description of the prior art.

An important feature of this embodiment of the invention is that ion emitting slit 130 is located between the positively-charged bodies in the upstream point of the propagation of the ions.

As compared to a conventional ion-beam source of the type shown in FIGS. 1–3, an advantage of ion source 100 of the invention with a virtual anode is that it operates with a higher efficiency, as a larger number of ions can be extracted from the plasma. Furthermore, the absence of a metal anode reduces contamination caused by erosion of the anode material. The geometry of the ion source 100 prevents leakage of electrons from the discharge volume to the rings, thus increasing free life of the electrons. This is because rings 104 and 106 have surfaces considerably smaller than the surface of a conventional anode plate, such as anode 54, and therefore probability of collision of electrons with the surface of the rings is lower than in the case of a plate-like electrode. Therefore, the free-path time of the electrons is longer, and the leakage currents are lower.

Figure 6:
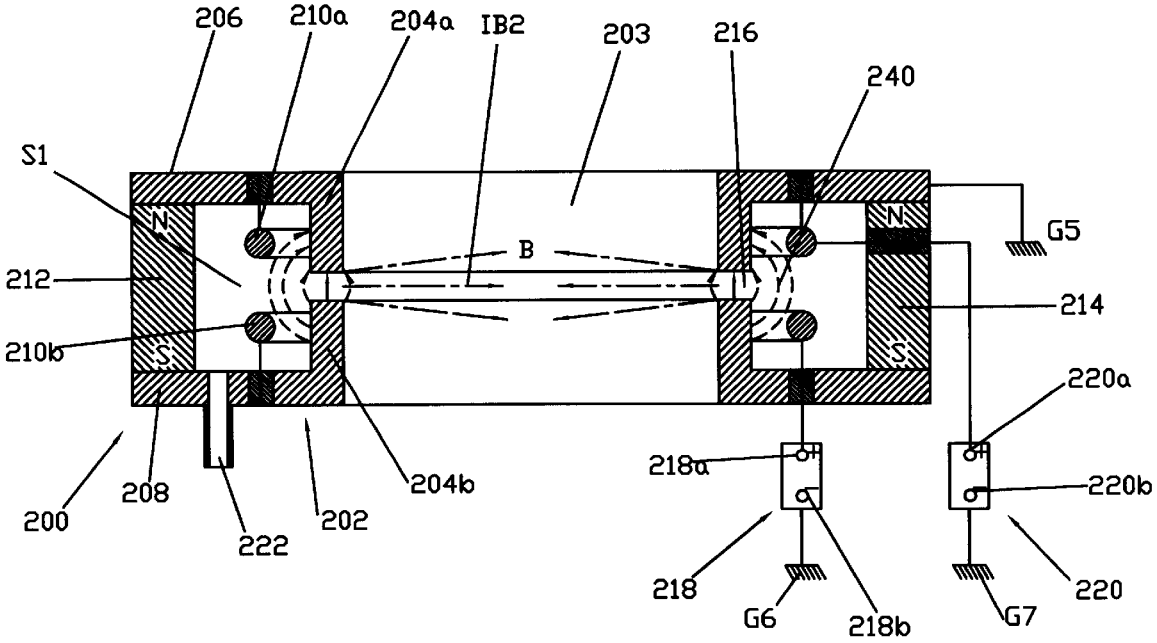
FIG. 6 is a sectional side view of an ion source of the invention with an external position of magnets and with propagation of the ion beam in the radial inward direction.

FIG. 6 is a sectional view of an ion-beam source 200 made in accordance with another embodiment of the invention. In this source, the plane of drift of electrons coincides with or parallel to the direction of propagation of the ion beam. Such an ion-beam source is described, e.g., U.S. Pat. No. 6,130,507 granted to the same applicants on Oct. 7, 2000. The vacuum chamber and the object are not shown. Ion-beam source 200 is a source of the type where the ion beam propagates radially inwardly in the direction parallel to the plane of drift of electrons. It is intended for treating outer surfaces of tubular objects. Ion beam source 200 has a housing or cathode 202 formed by two hollow tubular bodies 204*a* and 204*b* with a flanges 206 and 208, respectively. Housing 202 has a central opening 203. Bodies 206 and 208 are made of a magnetoconductive material such as Armco steel and are interconnected by permanent magnets 212 and 214 so that an ion-emitting slit 216 is formed between their ends, which are opposite to flanges 206 and 208 and face each other. Housing 202 is grounded at G5. Although only two magnets 212 and 214 are shown in FIG. 6, a plurality of such are arranged circumferentially between flanges 206 and 208 so that an annular space S1 is formed between magnets 206, 208, . . . and an outer surface of cylindrical body 204.

Anode rings 210*a* and 210*b* are connected to respective positive terminals 218*a*, 220*a* of respective direct current sources 218 and 220. Negative terminals 218*b* and 220*b* of these direct current sources are grounded at G6 and G7, respectively.

Working medium is supplied into space S1 via a gas supply tube 222.

Ion source 200 operates as follows:

Vacuum chamber (not shown in FIG. 6) is evacuated, and a working gas is fed into the interior of housing 202 of the ion source. A magnetic field (not shown) is generated by magnets 212, 214 . . . in space S1 between positively-charged bodies or rings 210*a* and 210*b*. Since in ion source 200 of the embodiment of FIG. 6 conventional metal anode 54 of the type shown in FIG. 1 is replaced by a pair of positively-charged bodies or rings 210*a* and 210*b*, a Penning discharge is generated near these rings.

The plasma, which is formed in the discharge, has an electric potential close to the potential of rings 210*a* and 210*b* and functions as a virtual anode of the ion source. On the other hand, the main process of ionization of the working gas occurs between cathode and anode in an ion-accelerating space 240 and in an ion-emitting slit 216, due to collisional ionization of the molecules of the working gas held and drifting in the crossed electric and magnetic fields. Replacement of the metallic anode by the plasma, i.e., by the virtual anode, ensures effective ionization of the working gas that passes through the plasma. This working gas passes sequentially through zone S1 of the virtual anode, between positively-charged rings 201*a* and 210*b*, through ion-accelerating gap 240, and then through ion-emitting slit 216. The ion beam IB2, which has been accelerated to a predetermined energy, is then propagates radially inwardly in the direction shown by arrow B in FIG. 6.

Drifting electrons held by the magnetic field move along helical trajectories and oscillate between inner surfaces 202*a* and 202*b* of two cylindrical bodies 204*a* and 204*b* of housing 202. When electrons collide with molecules of working gas, they form positive ions.

An important feature of the invention, i.e., that ion emitting slit 216 is located between the positively-charged bodies in the upstream point of the propagation of the ions, is also present in this embodiment.

As compared to a conventional ion-beam source of the type shown in FIGS. 1–3, an advantage of ion source 200 of the invention with a virtual anode is that it operates with a higher efficiency, as a larger number of ions can be extracted from the plasma. Furthermore, the absence of a metal anode reduces contamination caused by erosion of the anode material.

Figure 7:
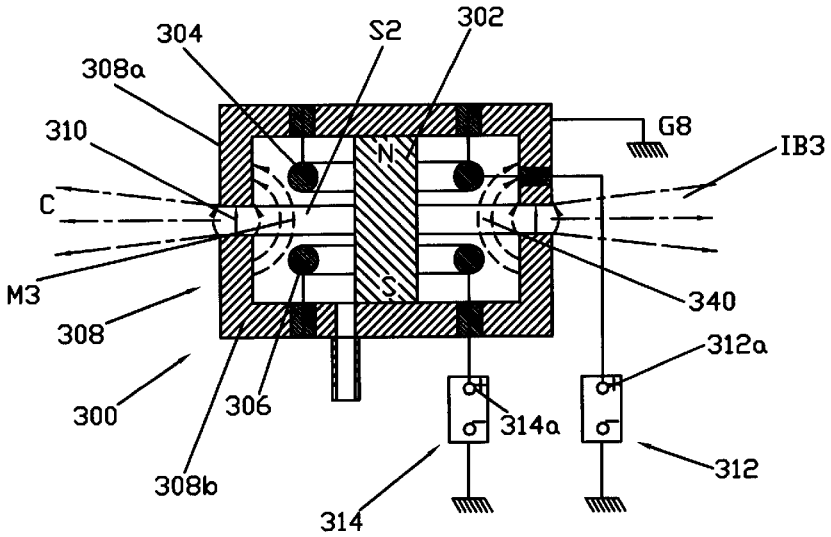
FIG. 7 is a sectional side view of an ion source of the invention with a central magnet and with propagation of the ion beam in the radial outward direction.

FIG. 7 illustrates another embodiment of the invention, which, in general is similar to that of FIG. 6 and relates to an ion-beam source 300 in which an ion beam 1133 is emitted in the radially outward direction. Except for the fact that a plurality of circumferentially arranged magnets of source of FIG. 6 are replaced by a central magnet 302 and that positively charged bodies or rings 304 and 36 surround magnet 302 from the outside, ion-beam source 300 is similar to ion-beam source 200. A housing 308 is formed by two cup-shaped bodies 308*a* and 308*b* having their open ends facing each other to form an ion-emitting slit 310. Housing 308 is grounded at G8, and rings 304, 306 are connected to positive terminals 312*a* and 314*a* of direct current sources 312 and 314.

Ion beam source 300 of FIG. 7 operates in the same manner as ion beam source 200 described earlier with reference to FIG. 6. However, ion beam 1133 is emitted in the plane of drift of electrons in the radial outward direction. Such an ion source is intended for treating inner surfaces of tubular objects.

Magnetic field M3 which is required for the Penning discharge is a scattered field that is closed between inner surfaces of cup-shaped bodies 308*a* and 308*b*.

Drifting electrons held by the magnetic field move along helical trajectories and oscillate between aforementioned inner surfaces of bodies 308*a* and 308*b*. When electrons collide with molecules of working gas, they form positive ions.

The plasma, which is formed in the discharge, has an electric potential close to the potential of rings 304 and 306 and functions as a virtual anode of the ion source. On the other hand, the main process of ionization of the working gas occurs between cathode and anode in an ion-accelerating space 340 and in an ion-emitting slit 310, due to collisional ionization of the molecules of the working gas held and drifting in the crossed electric and magnetic fields. Replacement of the metallic anode by the plasma, i.e., by the virtual anode, ensures effective ionization of the working gas that passes through the plasma. This working gas passes sequentially through zone S2 of the virtual anode, between positively-charged rings 304 and 306, through ion-accelerating gap 340, and then through ion-emitting slit 310. The ion beam IB3, which has been accelerated to a predetermined energy, is then propagates radially outwardly in the direction shown by arrow C in FIG. 7.

An important feature of the invention, i.e., that ion emitting slit 310 is located between the positively-charged bodies in the upstream point of the propagation of the ions, also presents in this embodiment.

As compared to a conventional ion-beam source of the type shown in FIGS. 1–3, an advantage of ion source 300 of the invention with a virtual anode is that it operates with a higher efficiency, as a larger number of ions can be extracted from the plasma. Furthermore, the absence of a metal anode reduces contamination caused by erosion of the anode material. As has been mentioned above, ion source 300 is intended for treating inner surfaces of tubular objects.

Figure 8:
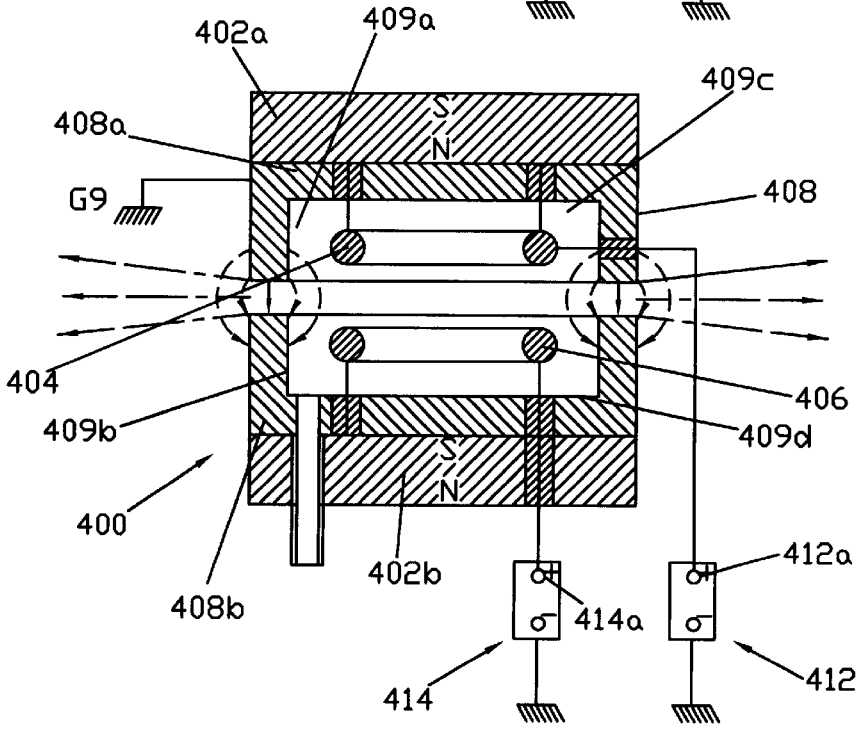
FIG. 8 is a sectional side view of an ion source of the invention with external positions of the magnets and with propagation of the ion beam in the radial outward direction.

FIG. 8 illustrates another embodiment of the invention which is similar to the one described above with reference to FIG. 7 and differs from it in that magnets have external position with respect to the housing. More specifically, an ion-beam source 400 has cylindrical housing 408 formed by two cup-shaped bodies 408*a* and 408*b* having their open ends facing each other to form an ion-emitting slit 410. Housing 408 is grounded at G9, and rings 404, 406 are connected to positive terminals 412*a* and 414*a* of direct current sources 412 and 414. A plurality of permanent magnets 402*a*, 402*b* . . . (only two of which are shown in FIG. 8) are arranged circumferentially around housing 408.

Ion beam source 400 of FIG. 8 operates exactly in the same manner as ion beam source 300 described earlier with reference to FIG. 7. However, the Penning discharge is maintained not only between cylindrical surfaces 409*a* and 409*b* of cup-shaped bodies, as in the embodiment of FIG. 7, but also between bottoms 409*c* and 409*d* of cup-shaped bodies 408*a* and 408*b*. This ion source is also intended for treating inner surfaces of tubular objects. In a cross-section perpendicular to plane of the drawing, ion sources shown in FIGS. 4 through 8 may have a round, elliptical, or oval configuration.

Figure 9:
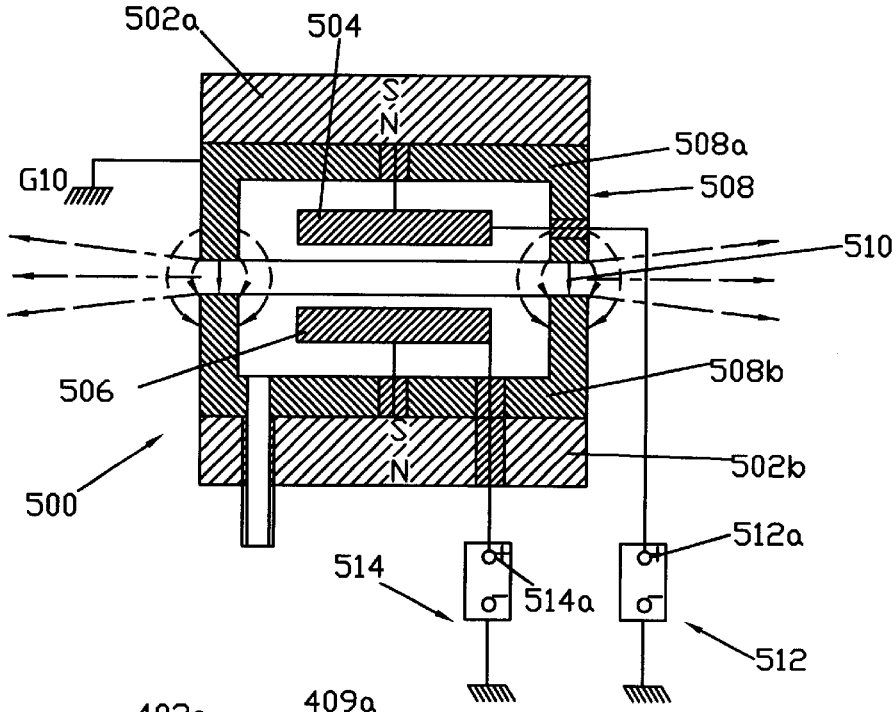
FIG. 9 is a sectional side view of an ion source of the type similar to the one of FIG. 8, but with positively charged bodies in the form of disks.

An embodiment of the invention shown in FIG. 9 is similar to the one of FIG. 8 and differs from it in that positively charged rings 304 and 306 are replaced by two positively charged disks. More specifically, an ion source 500 has a housing 508 formed by two cup-shaped bodies 508*a* and 508*b* having their open ends facing each other to form an ion-emitting slit 510. Housing 508 is grounded at GI. In this embodiment, rings 404, 406 of the embodiment of FIG. 8 are replaced by two disks 504 and 506 connected to positive terminals 512*a* and 514*a* of direct current sources 512 and 514. A plurality of permanent magnets 502*a*, 502*b* . . . (only two of which are shown in FIG. 9) are arranged circumferentially around housing 508.

Ion beam source 500 of FIG. 9 operates exactly in the same manner as ion beam source 300 described earlier with reference to FIG. 7. It is also intended for treating inner surfaces of tubular objects.

Figure 10:
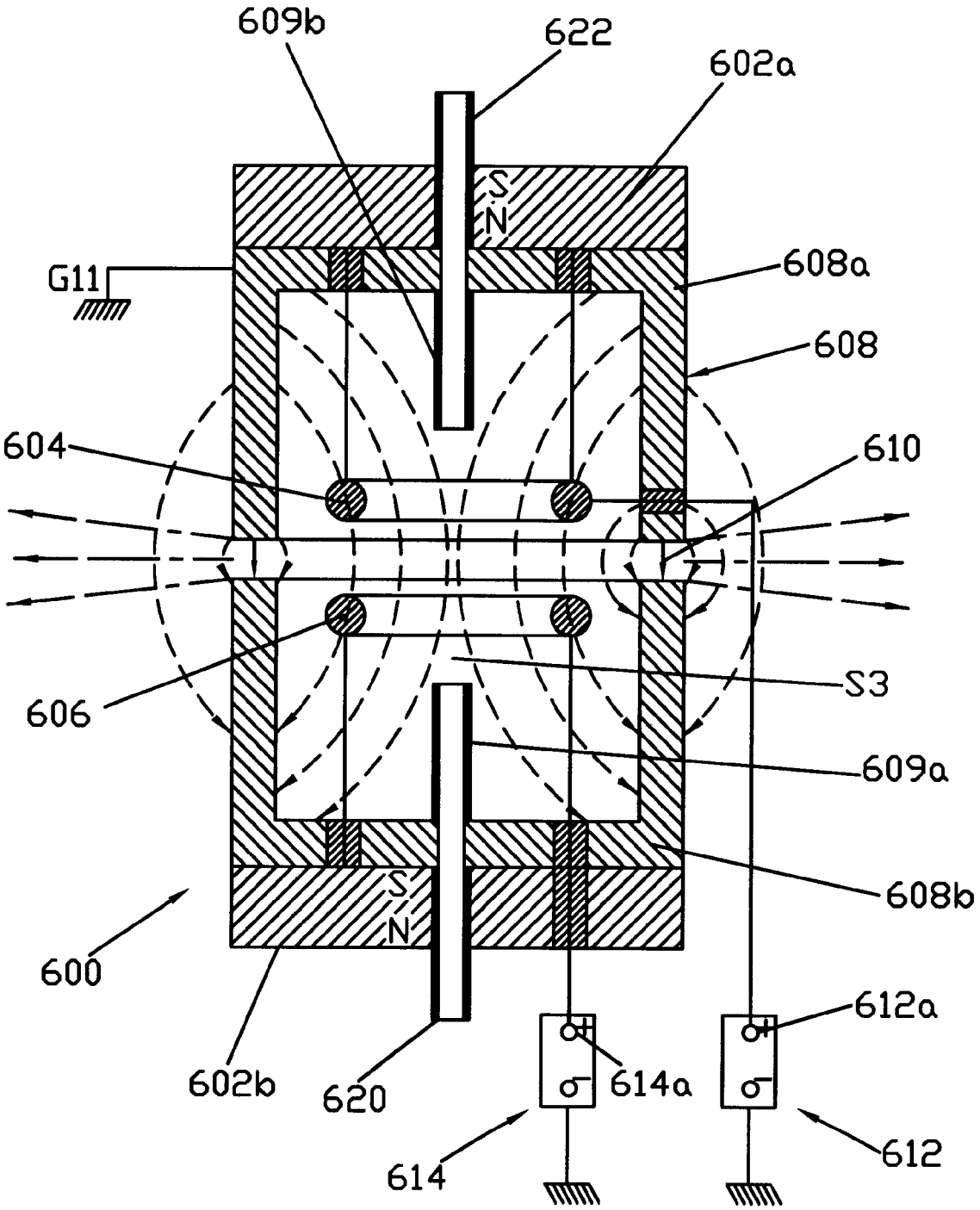
FIG. 10 is a sectional side view of an ion beam source similar to the one shown in FIG. 8, but with the hollow cathode operating in conjunction with the Penning discharge and used for efficiency of ionization and for increasing the ion beam current density.

FIG. 10 illustrates another embodiment of the invention which is similar to the one described above with reference to FIG. 8 and differs from it by a provision of a hollow cathode for generating a Penning discharge. More specifically, an ion-beam source 600 has cylindrical housing 608 formed by two cup-shaped bodies 608*a* and 608*b* having their open ends facing each other to form an ion-emitting slit 610. Housing 608 is grounded at G11, and rings 604, 606 are connected to positive terminals 612*a* and 614*a* of direct current sources 612 and 614. A plurality of permanent magnets 602*a*, 602*b* . . . (only two of which are shown in FIG. 10) are arranged circumferentially around housing 608.

Ion beam source 600 of FIG. 10 differs from ion beam source 400 of FIG. 8 in that a cathode for generating the Penning discharge is a hollow cathode formed by metal tubes 609*a* and 609*b* which are electrically connected with grounded housing 608 and are directed axially inwardly from the inner walls of housing 608 toward positively charge rings 604 and 608. These tubes serve also for the supply of a working gas to a plasma formation space S3. For these purpose tubes 609*a* and 609*b* are coaxial with gas-supply tubes 620 and 622, respectively. If necessary, only one tube, e.g., 609*a*, can be connected to the gas supply system, and the second tube 609*b* can be used for symmetry of the electric and magnetic fields generated in the Penning discharge.

Ion beam source 600 of FIG. 10 operates exactly in the same manner as ion beam source 400 described earlier with reference to FIG. 8. It is also intended for treating inner surfaces of tubular objects.

The hollow cathode of FIG. 10 increases efficiency of ionization and concentrates plasma, i.e., increases density of the ion beam current.

Thus it has been shown that invention provides an ion-beam source with a virtual anode which is characterized by high ion beam current, high efficiency of ionization, reduced degree of contamination of the ion beam with erosion particles due to the absence of a metallic anode, and by possibility of operation of the source in a wider range of pressure. Although the invention has been shown and described with reference to specific embodiments, it is understood that these embodiments were given only as examples and that any changes and modifications are possible, provided they do not depart from the scope of the appended claims. For example, wires that form positively-charged rings may have a cross-section other than round. Wires can be made of various materials such as tungsten, molybdenum, titanium, carbon, etc. The rings can be replaced by perforated annular bodies, or by thin net-like plates. Although the adjustment of the parameters and shape of the beam by applying different potentials to the rings were described only in connection with the embodiment of FIG. 4, it is understood that this principle is applicable to ion sources of any embodiments of the invention. The same is true for positioning the rings in different planes. It has been mentioned that the rings are made of thin wires only in the description of the embodiment of FIG. 4. It is understood, however, that this is true also for all the embodiment of the invention utilizing ring-like positively-charged bodies.

What is claimed is:

1. An ion-beam source of the type having a closed-loop ion emitting slit and electrons drifting in a crossed electric field and first magnetic field, comprising:

hollow housing means with at least one closed-loop ion-emitting slit;

anode means in said hollow housing means in the form of at least two positively charged bodies arranged on opposite sides of said ion-emitting slit, said ion-emitting slit being located in the upstream position of the propagation of the ion beam with respect to said anode means;

first cathode means for operation in conjunction with said anode means in order to generate said first magnetic field for generating and accelerating said ion beam;

second cathode means for operation in conjunction with said anode means in order to generate a Penning discharge for a second magnetic field;

magnetic field generation means for generating said first magnetic field and said second magnetic field; and working medium supply means for supplying a working medium to a space between said anode means and said first cathode means.

2. The ion-beam source of claim 1, wherein said at least two positively charged bodied are rings made of a conductive material, said ion-beam source having means of a positive electric potential which are connected to said rings.

3. The ion-beam source of claim 2, wherein said first cathode means comprises one part of said hollow housing means, and said second cathode comprises another part of said hollow housing means.

4. The ion-beam source of claim 3, wherein said ion-emitting slit is formed in said one part of said housing and is located above said positively charged bodies and between said at least two rings, said second magnetic field being oriented in the direction substantially perpendicular to a plane passing through said rings.

5. The ion-beam source of claim 4, wherein said rings are concentric rings consisting of an inner ring and an outer ring, said magnetic field generation means being a permanent magnet located in said hollow housing means inside said an inner ring.

6. The ion-beam source of claim 3, wherein said ion-emitting slit is formed in said one part of said housing and is located radially inwardly with respect to said ion-emitting slit and between said at least two rings, said second magnetic field being oriented in the direction substantially parallel to a plane passing through said rings.

7. The ion-beam source of claim 6, wherein said rings are concentric rings arranged one above the other on opposite sides of said ion-beam emitting slit, said magnetic field generation means being a plurality of permanent magnets located outside said hollow housing means outside said rings.

8. The ion-beam source of claim 6, wherein said rings are concentric rings arranged one above the other on opposite sides of said ion-beamn emitting slit, said magnetic field generation means being a permanent magnet located inside said hollow housing means and inside said rings.

9. The ion-beam source of claim 6, wherein said rings are concentric rings arranged one above the other on opposite sides of said ion-beam emitting slit, said magnetic field generation means being a plurality of per manent magnet s located outside of said hollow housing means and outside said rings.

10. The ion-beam source of claim 1, wherein said a t least two positively charged bodied are disks made of a conductive material, said ion-beam source having means of a positive electric potential which are connected to said disks.

11. The ion-beam source of claim 10, wherein said first cathode means comprises one part of said hollow housing means, and said second cathode comprises another part of said hollow housing means.

12. The ion-beam source of claim 11, wherein said disks are arranged one above the other on opposite sides of said ion-beam emitting slit, said magnetic field generation means being a plurality of permanent magnets located outside said hollow housing means and outside with respect to said rings.

13. The ion-beam source of claim 8, wherein said second cathode means is a hollow cathode formed by at least one tube of a magnetoconductive material, which extends radially inwardly from said other part of said hollow housing means toward at least one of said rings.

14. The ion-beam source of claim 13, wherein said hollow cathode means is connected to said working medium supply means for the supply of said working medium into said space between said anode means and said second cathode means.

15. A method of generating an ion beam in an ion-beam source of the type having a closed-loop ion emitting slit and electrons drifting in a crossed electric field and first magnetic field, comprising:

providing said ion-beam source with a housing, at least anode means, first cathode means, and second cathode means in said housing, magnetic field generation means, means of a positive potential connected to said anode means, and working medium supply means for supplying a working medium to a space between said anode means and said first cathode means;

generating an electric field in the vicinity of and across said closed-loop ion-emitting slit under the effect of said means of a positive potential;

generating a first magnetic field perpendicular to said electric field under the effect of said magnetic field generating a second magnetic field between said second cathode means and said anode means;

supplying said working medium into said housing to the area between said second cathode means and said anode means;

generating a Penning discharge, thus generating a Penning discharge plasma which has a positive potential with respect to said second cathode close to a positive potential of said anode means, thus forming a virtual anode;

generating positive ions in said plasma;

extracting said positive ions from said plasma by means of an electric field between said virtual anode and said first cathode; and generating an ion beam emitted through said closed-loop ion-emitting slit.

16. The method of claim 15, wherein said anode means comprises at least two bodies, positively charged from said means of positive potential.

17. The method of claim 16, further comprising the step of:

adjusting the parameters and shape of said ion beam by supplying to said at least two bodies different positive potentials.

18. An ion-beam source of the type having a closed-loop ion emitting slit and electrons drifting in a crossed electric field and first magnetic field, comprising:

a hollow housing with a closed-loop ion-emitting slit;

anode means in said hollow housing means in the form of two positively charged rings arranged on opposite sides of said ion-emitting slit, said ion-emitting slit being located in the upstream position of the propagation of the ion beam with respect to said anode means;

first cathode means for operation in conjunction with said anode means in order to generate said first magnetic field for generating and accelerating said ion beam;

second cathode means for operation in conjunction with said anode means in order to generate a Penning discharge for a second magnetic field;

at least one permanent magnet for generating said first magnetic field and said second magnetic field; and working medium supply means for supplying a working medium to a space between said anode means and said first cathode means;

said rings being made of a metal wire.

* * * * *